US009339682B2

(12) United States Patent
Braier et al.

(10) Patent No.: US 9,339,682 B2
(45) Date of Patent: May 17, 2016

(54) MOUNTABLE EXERCISE APPARATUS

(71) Applicant: Kayo Technology, Inc., Madison, WI (US)

(72) Inventors: Robert A. Braier, Madison, WI (US); David J. Grandin, Madison, WI (US); Leslie A. Wagner, Mukwonago, WI (US)

(73) Assignee: Kiio Inc., Madison, WI (US)

( * ) Notice: Subject to any disclaimer, the term of this patent is extended or adjusted under 35 U.S.C. 154(b) by 94 days.

(21) Appl. No.: 14/075,747

(22) Filed: Nov. 8, 2013

(65) Prior Publication Data

US 2015/0133278 A1 May 14, 2015

(51) Int. Cl.

| | |
|---|---|
| ***A63B 21/00*** | (2006.01) |
| ***A63B 21/04*** | (2006.01) |
| ***A63B 21/055*** | (2006.01) |
| ***A63B 21/16*** | (2006.01) |
| *A63B 71/06* | (2006.01) |

(52) U.S. Cl.

CPC ..... *A63B 21/169* (2015.10); *A63B 21/0442* (2013.01); *A63B 21/0557* (2013.01); *A63B 21/1618* (2013.01); *A63B 2071/0694* (2013.01)

(58) Field of Classification Search

CPC ..... A63B 21/0012; A63B 21/00003; A63B 21/00007; A63B 21/00029; A63B 21/06; A63B 21/14; A63B 21/1434; A63B 21/1438; A63B 21/15; A63B 21/151; A63B 21/154; A63B 21/156; A63B 21/16; A63B 21/1627; A63B 21/1681; A63B 2021/169; A63B 22/0002; A63B 22/0046; A63B 21/04; A63B 21/0442; A63B 21/055; A63B 21/0552; A63B 21/0555; A63B 21/0557; A63B 21/1636; A63B 21/1645; A63B 21/1663

See application file for complete search history.

(56) References Cited

U.S. PATENT DOCUMENTS

| | | | | |
|---|---|---|---|---|
| 3,115,339 | A * | 12/1963 | Forte | 482/139 |
| 3,966,203 | A * | 6/1976 | Bickford | 482/103 |
| 4,747,594 | A | 5/1988 | Houde | |
| 4,909,505 | A | 3/1990 | Tee | |
| 5,040,785 | A | 8/1991 | Charnitski | |
| 5,468,205 | A | 11/1995 | McFall | |
| 5,626,546 | A | 5/1997 | Little | |
| 5,996,287 | A | 12/1999 | Sullivan | |
| 6,267,711 | B1 | 7/2001 | Hinds | |
| 6,319,179 | B1 | 11/2001 | Hinds | |
| 6,322,483 | B1 | 11/2001 | Rotella | |
| 6,328,571 | B1 | 12/2001 | Dricken | |
| 6,494,817 | B2 * | 12/2002 | Lake | 482/93 |
| 6,908,418 | B2 | 6/2005 | Saure | |
| 6,941,620 | B1 | 9/2005 | Hinds | |
| 7,625,325 | B1 | 12/2009 | Yost | |
| 7,727,131 | B2 | 6/2010 | Longo | |
| 7,819,784 | B1 | 10/2010 | Caswell | |

(Continued)

*Primary Examiner* — Loan H Thanh
*Assistant Examiner* — Megan Anderson
(74) *Attorney, Agent, or Firm* — Jennifer L. Gregor; Godfrey & Kahn, S.C.

(57) ABSTRACT

An exercise apparatus that is mountable to a substrate, having a channel, a belt, and at least one buckle. The buckle has a bottom portion that is adapted to fit within the channel such that the buckle can move along the channel and resist moving in either perpendicular direction. The buckle has a top portion that includes an opening for attaching exercise equipment and at least one cam. The cam is selectively engaged with the belt such that when the cam is disengaged, the buckle can be moved along the belt and when engaged, the buckle resists movement with respect to the belt.

18 Claims, 13 Drawing Sheets

(56) References Cited

U.S. PATENT DOCUMENTS

| | | | | |
|---|---|---|---|---|
| 7,976,445 | B2 | 7/2011 | Lalaoua | |
| 8,057,370 | B2 | 11/2011 | Dunn | |
| 8,157,712 | B1 | 4/2012 | Musachio | |
| 8,485,951 | B1 * | 7/2013 | Adams | 482/129 |
| 2003/0186792 | A1 | 10/2003 | Keeler | |
| 2006/0040813 | A1 * | 2/2006 | Murphy et al. | 482/148 |
| 2006/0084556 | A1 | 4/2006 | Payne | |
| 2010/0048368 | A1 | 2/2010 | Donofrio | |
| 2010/0137112 | A1 * | 6/2010 | Harker | 482/92 |
| 2011/0237410 | A1 | 9/2011 | Perez | |
| 2013/0035220 | A1 | 2/2013 | Adams | |

* cited by examiner 28
32
29
48
22
26
22
14
14
12
44
46
40
36
50
34
38
42

MOUNTABLE EXERCISE APPARATUS

FIELD OF THE INVENTION

The present invention relates generally to the field of exercise or physical therapy equipment. More specifically, the invention relates to a multi-use exercise apparatus that can be mounted to a vertical substrate, such as a wall.

BACKGROUND OF THE INVENTION

Although exercise equipment that attaches to walls, doors, and other vertical surfaces is known in the prior art, these types of mounted exercise devices have not been fully optimized. Some examples of prior art wall or door mounted exercise devices include those described in U.S. Pat. Nos. 8,057,370; 6,319,179; 6,267,711; 6,941,620; and U.S. Publication No. 2010/0048368. The inventors have improved on several dimensions of the prior art in this field.

For example, one problem with certain prior art devices is that the vertically mounted exercise equipment only provides for incremental adjustment of the height or spacing of certain aspects of the equipment. The system described in U.S. Pat. No. 8,057,370 discloses an apparatus having this problem. The wall mountable resistance apparatus in the '370 patent has a track that is mounted to a wall and a slide with a hook for attaching a band movable on the track. The slide is positioned on the track by inserting the plunger into one of a number of holes formed in the track. However, the slide may only be positioned along the track at the locations where there are holes in the track. This can prevent positioning of the slide at the most comfortable, effective or otherwise desirable spot. Further, the more holes the track has, the weaker the track will become and thus more prone to failure when being used.

Another challenge faced by the designers of the prior art devices is providing an efficient, yet strong, base for the exercise apparatus and an effective attachment to the substrate to which the apparatus is mounted. For example, U.S. Pat. No. 6,941,620 discloses an adjustable strap assembly wherein a strap is attached to a door, such as by wrapping it around a door, and a cord is attached to the strap by an adjustable fastener. One disadvantage of such an assembly is that when the cord is pulled during exercise, the strap will tend to pull away from the door. This pull is undesirable for a number of reasons. First, it decreases the effectiveness of the exercise. Second, when the cord is released and the fastener and strap return to the door, unnecessary and distracting noise is made. Third, when the strap and fastener are repeatedly pulled from and returned to the door, damage to the door can result. Another disadvantage of such an assembly is that the strap at the top and bottom of the door may make it difficult to open or close the door with the strap attached.

As such, there is a need for a mounted exercise apparatus that provides an efficient, yet strong connection to the vertical substrate to which it is mounted, as well as a sturdy connection between the apparatus and the straps, cords, bands, or other resistance elements used during exercise. It is similarly desirable to provide for the easy adjustment of continuous or infinite position settings, rather than pre-determined or incremental settings, for the various elements of the exercise apparatus. The inventors have improved on these and other aspects of the various prior art devices in this field.

SUMMARY OF THE INVENTION

The present invention relates to a mountable exercise apparatus. In one embodiment, the apparatus has a base, a channel with a first end and a second end, a belt, and at least one buckle. The channel cooperates with the base such that the channel and the base can be mounted to a surface. The belt has a first end connected to the first end of the channel and a second end connected to the second end of the channel. The at least one buckle has a top portion and a bottom portion, where the bottom portion is adapted to fit within the channel such that the at least one buckle is moveable along the channel and resist moving in either perpendicular direction thereto. The top portion of the at least one buckle includes an attachment portion for attaching exercise equipment and at least one cam. The at least one cam is selectively engaged with the belt such that when the at least one cam is disengaged, the at least one buckle can be moved along the belt and when engaged, the at least one buckle resists movement with respect to the belt.

In another embodiment, the apparatus has a vertical support, and a vertical raceway that is connected to the vertical support, and a web. The top of the web is connected to the top of the vertical support and the bottom of the web is connected to the bottom of the vertical raceway. At least one buckle is connected to the web and the vertical raceway by a selectably engaging mechanism such that the buckle or buckles can be moved along the web and vertical support when the selectably engaging mechanism is disengaged and such that the buckles resist movement when the selectably engaging mechanism is engaged.

In another embodiment, the apparatus has a back plate and a channel, and screws can be used with holes in the back plate and channel to mount the back plate and the channel to a wall. The back plate also has a surface for holding and displaying information. A belt has a first end engaged with the top of the channel and a second end connected to a winch. The winch is sized to fit within the bottom of the channel such that when the winch is operated, the belt is tightened and the winch is secured in position with respect to the channel. Alternatively, a cam or cinch could also be used to tighten and secure the belt to the channel without departing from the spirit of the invention. At least one buckle includes an attachment portion, at least one foot that is sized to fit within and continuously engage the channel, and at least two cams. Each of the at least two cams are operable such that when each of the at least two cams are closed, the at least one buckle engages the belt and when each of the at least two cams is opened, the at least one buckle is moveable along the belt. An exercise device is attached to the attachment portion such that it may be used for exercising. The apparatus also may have a first cap sized to fit over the top of the channel and belt and a second cap sized to fit over the winch and the bottom of the channel.

It will be understood by those skilled in the art that one or more aspects of this invention can meet certain objectives, while one or more other aspects can lead to certain other objectives. Other objects, features, benefits and advantages of the present invention will be apparent in this summary and descriptions of the disclosed embodiment, and will be readily apparent to those skilled in the art. Such objects, features, benefits and advantages will be apparent from the above as taken in conjunction with the accompanying figures and all reasonable inferences to be drawn therefrom.

DETAILED DESCRIPTION

Figure 1:
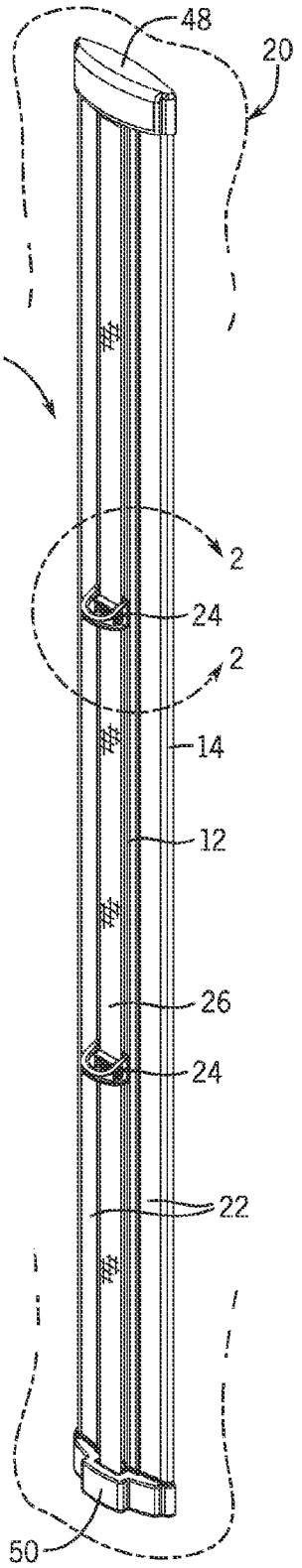
FIG. 1 is an isometric view of an exercise apparatus in accordance with the invention.

Referring to the figures, an exercise apparatus 10 includes a base 14, a belt 26, and one or more buckles 24. A belt 26 is mounted to the base 14, and one or more buckles 24 are attached to the belt 26. Exercise devices such as straps, cords, resistance bands, tubing, cables, or other devices can then be attached and detached to the buckles 24. The buckles 24 may be positioned at any point along the belt 26. By using the combination of a belt 26 and buckle 24 or buckles, the user can adjust the placement or anchor of the attached exercise devices in an infinite number of positions along the belt 26 and substantially to each end or the top and bottom of the belt. With this type of configuration, the user is not limited to discrete or pre-determined attachment positions on the apparatus. Adjustment of the placement of a buckle 24 is also smooth because the buckle does not travel over bumps, grooves, or other stop positions as the buckle is adjusted on the belt 26.

Figure 2:
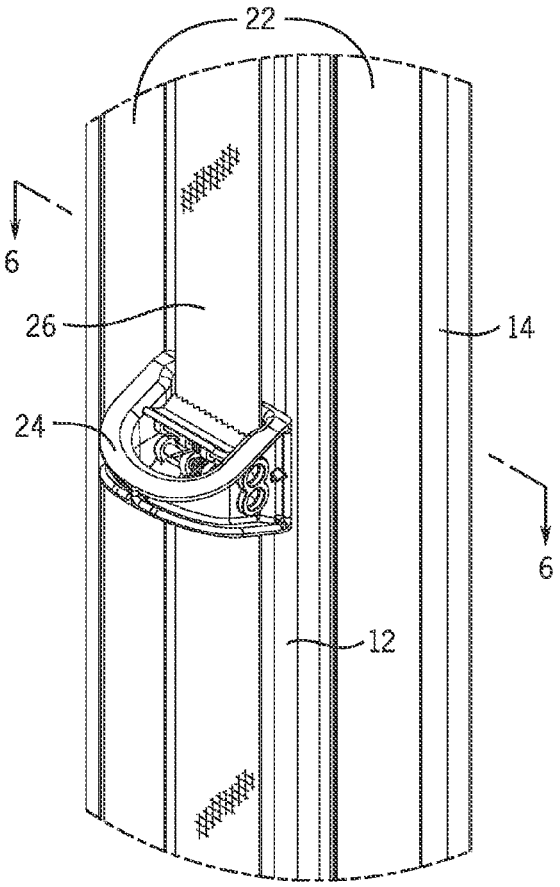
FIG. 2 is an enlarged view of the buckle shown within the area of line 2-2 in FIG. 1.
Figure 3:
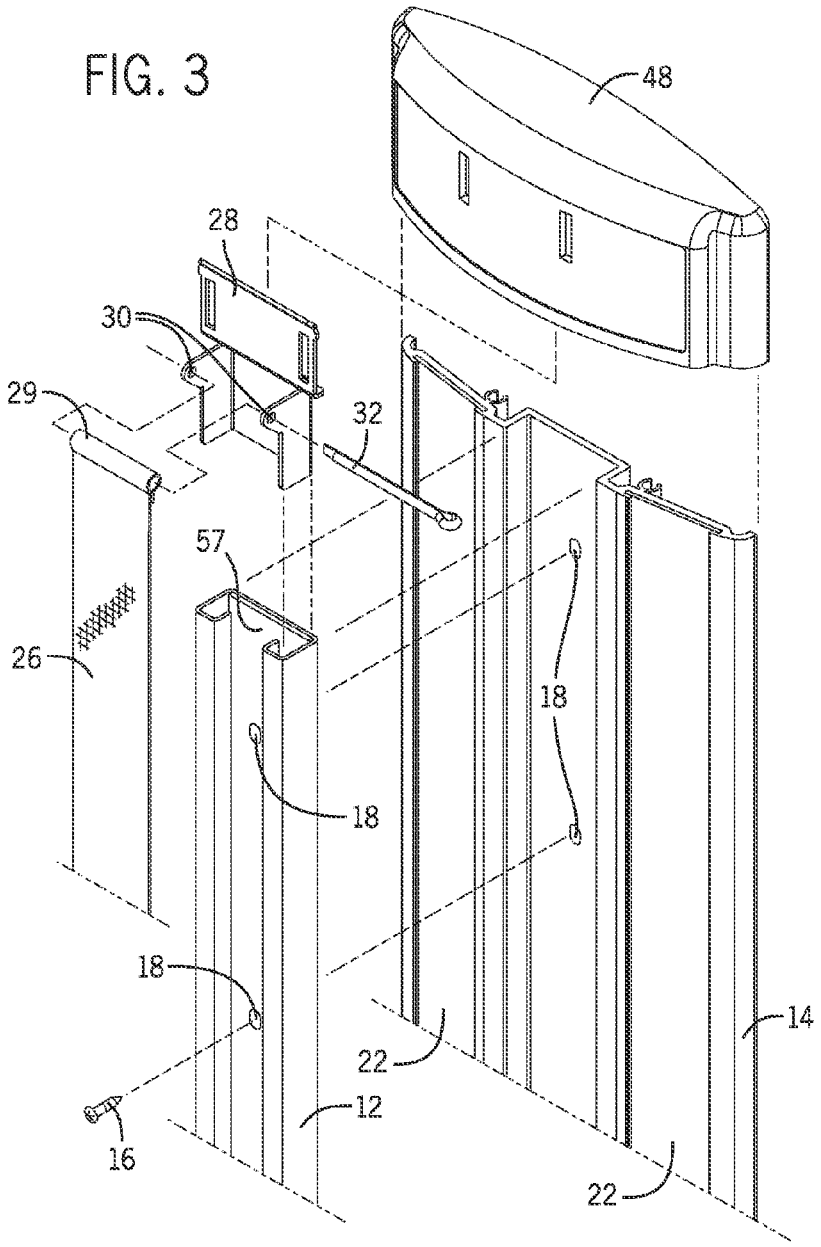
FIG. 3 is an exploded perspective view of the top of the exercise apparatus shown in FIG. 1, showing the connection for the belt to the top end of the apparatus.
Figure 4:
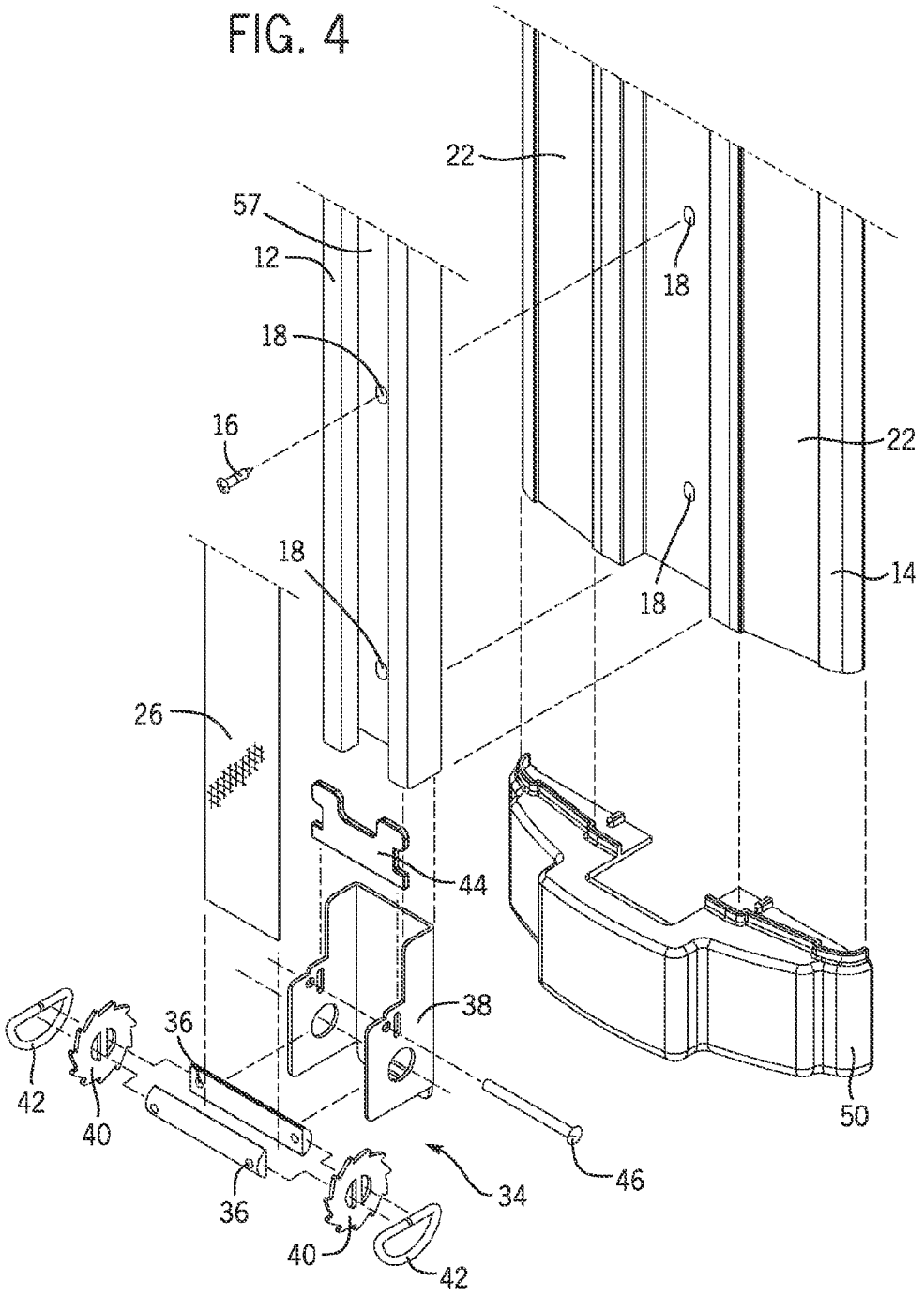
FIG. 4 is an exploded perspective view of the bottom of the exercise apparatus shown in FIG. 1, showing the connection for the belt to the bottom end of the apparatus.

As shown in FIGS. 1 and 2, the base 14 includes a channel 12 that is sized to fit within a passage of or upon base 14. The exercise apparatus 10 may be mounted to a substrate 20. Appropriate mounting substrates may include a wall, door or any other surface sufficiently sturdy for the intended use of the apparatus 10. Many appropriate mounting methods will be readily apparent to a person of ordinary skill in the art. But, as shown in FIGS. 3 and 4, one method for mounting the exercise apparatus 10 to the substrate 20 is the use of screws 16 that can be inserted through matching holes 18 in the base 14 and channel 12 and into a stud in a substrate 20. A variety of materials from which the exercise apparatus 10 may be manufactured will also be apparent to one of ordinary skill in the art. For example, the base 14 may be made of rigid PVC and the channel 12 from stainless steel, however other materials may be used without departing from the spirit of the invention. Although the mounted exercise apparatus 10 shown and discussed further below is mounted vertically, the apparatus 10 could also be mounted horizontally or in combination with additional apparatuses.

Figure 13:
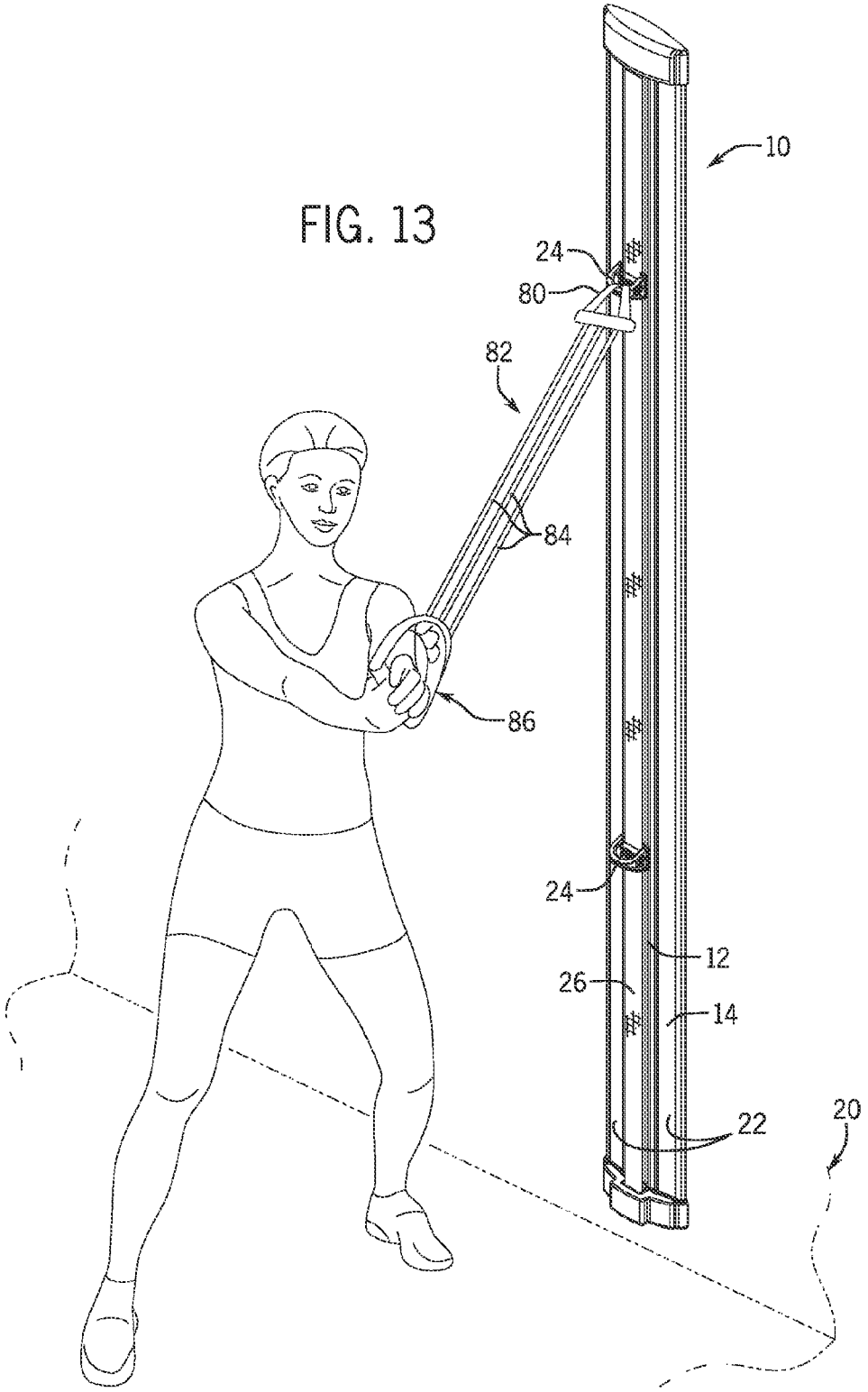
FIG. 13 is an environmental view of an exercise apparatus in accordance with the present invention being used with resistance cables.
Figure 15:
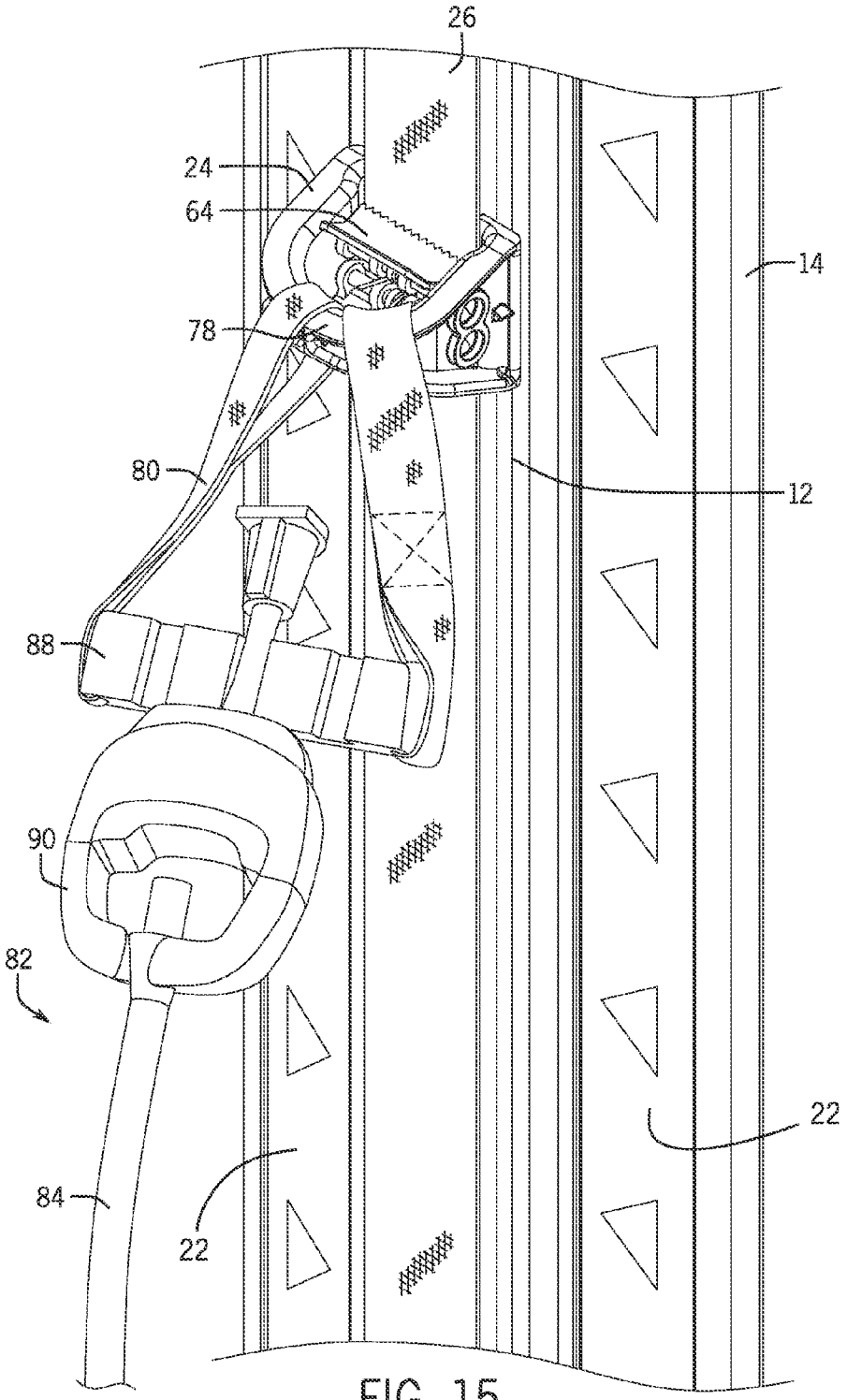
FIG. 15 is a perspective view of a buckle for an exercise apparatus in accordance with the present invention, showing straps attached to the attachment portion of the buckle along with an attachment anchor, a force sensing device, and a resistance cord.

As shown in the figures, particularly FIGS. 1, 13 and 15, the base 14 has a surface 22 on each side of channel 12, which may be used or adapted for holding or displaying information or graphics. For example, surface 22 may display logos, artwork, or information, such as markings for suggested positioning of the buckles 24, information regarding suggested exercises or branding and advertising. As shown in FIG. 15, the surface 22 has triangular markings that may indicate placement positions for the buckle 24 to assist with repeatability of exercises. The surface 22 on each side of the base 14 also helps give the mounted exercise apparatus 10 a more appealing, professional and quality look in that it appears substantive and durable. Although the base 14 shown in FIG. 1 is substantially rectangular, other known shapes could also be used without departing from the spirit of the invention, such as a flat panel, cylinder, or other configurations.

Figure 5:
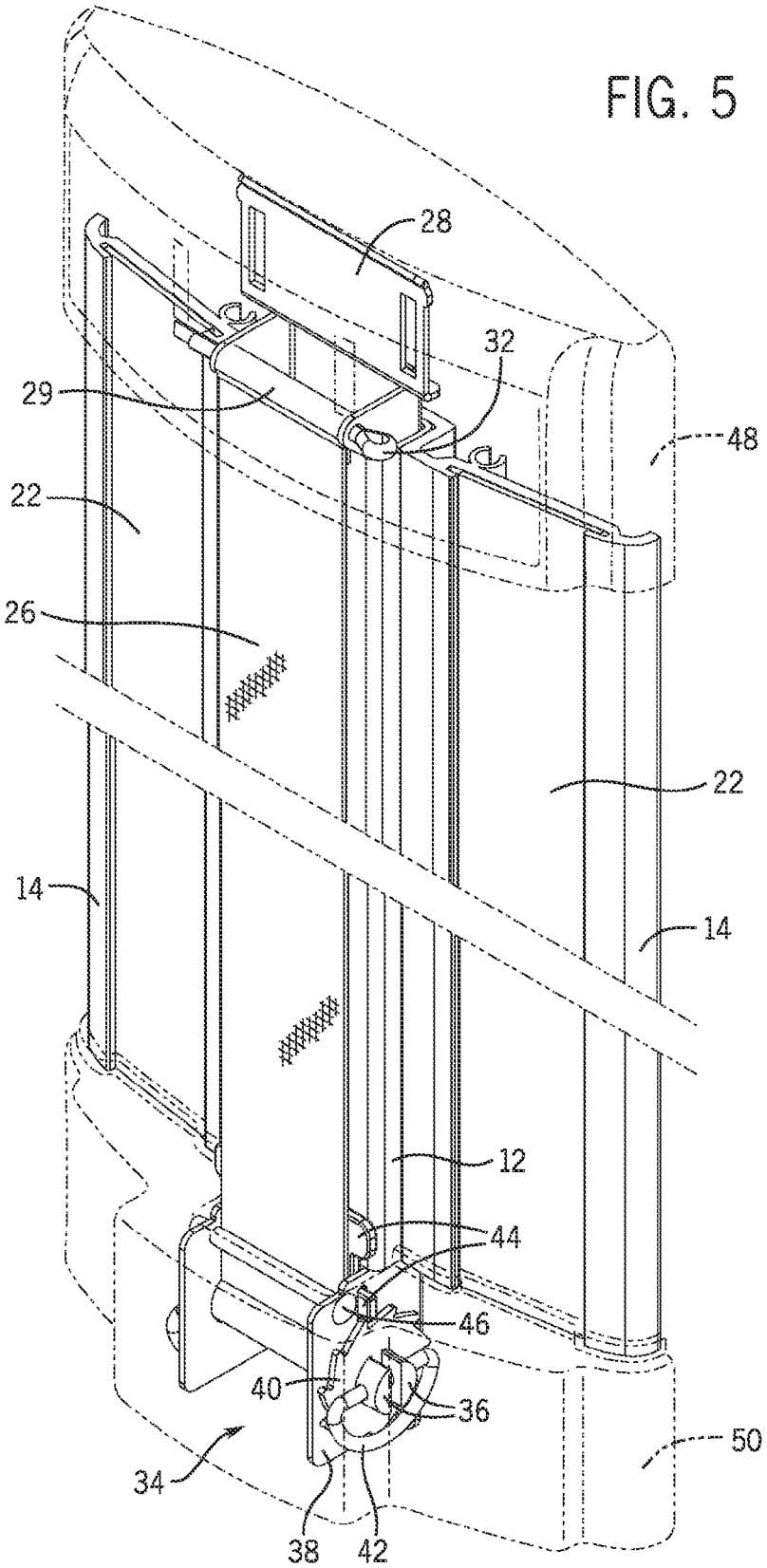
FIG. 5 is a perspective view of the top and bottom of the exercise apparatus shown in FIG. 1, showing the connection of the belt to the apparatus.

As seen in FIGS. 3 and 5, one end of the belt 26 is connected to the top of the channel 12 through the use of a support 28. The support 28 could have a variety of shapes, but as shown in FIGS. 3 and 5, the support 28 includes a generally flat plate having an upper vertical portion and a lower portion that is capable of interacting or resting in the channel 12, and also having attachment points 30. As shown in the figures, one end of the belt 26 has a loop 29. Each end of the loop 29 is matched up with the attachment points 30 from the support 28 and a pin 32 is inserted through the loop 29 such that the belt 26 is securely held by in place at attachment points 30. The support 28 is inserted into the channel 12 to hold the top of the belt 26 in place. The belt 26 is preferably made from polypropylene, but could also be manufactured from a variety of other materials.

As seen in FIGS. 4 and 5, the other end of the belt 26 is connected to the bottom of the channel 12 in a manner that permits a suitable amount of tension to be applied to the belt. In the embodiment shown, the belt 26 is inserted in a winch which is in turn connected to the channel 12. The winch 34 has a split spool 36 that runs through the winch base 38. On each end of the split spool 36 is a sprocket 40 with holes adapted to fit over the split spool 36. A 'D' ring 42 is inserted through each end of the split spool 36. The 'D' rings 42 are used to turn the split spool 36 in order to tighten the belt 26. The sprockets 40 include teeth which are adapted to cooperate with a lock plate 44 in order to permit rotation of the sprockets 40 in one direction for tightening of the belt 26, and prevent the sprockets 40 from moving in a reverse direction resulting in the loosening of the belt 26. A guide pin 46 is passed through the winch base 38 above the winch 34, positioned so as to help keep the belt 26 correctly orientated in the winch 34. When the belt 26 is tightened through the use of the winch 34, the belt 26, support 28 and winch 34 will be held securely in place. Other methods for securing belt 26 to the exercise apparatus 10 could be used as well; for example, the belt 26 could be secured directly to the base 14, rather than to the channel 12. Nor is it required that belt 26 be attached as shown in the accompanying Figures; alternatives to the support and winch-style attachment shown could be used within the spirit of the invention as well, such as a bolted, riveted, or screwed attachment mechanism, or other adjustable or removable belt attachment systems.

Exercise apparatus 10 may also optionally include end caps, such as shown in the figures; top cap 48 may be placed over the top of the exercise apparatus 10 and snapped onto the support 28 to conceal it. A bottom cap 50 may be placed over the bottom of the exercise apparatus 10 and snapped onto the winch 34 to conceal the winch 34. The top 48 and bottom caps 50 are preferably made from plastic and can have guide pins that slide into the channel 12 to ensure that the caps 48, 50 stay in a fixed position during use of the mounted exercise apparatus 10. The top 48 and bottom caps 50 may provide a more professional and pleasing appearance as there is no visible mounting hardware. The top 48 and bottom caps 50 may also prevent further unwanted manipulation of the belt 26 and prevent the printed information from being removed from the surfaces 22 of the base 14.

When fully assembled and installed, the exercise apparatus 10 gains stability and rigidity from the shape and nature of the base 14 and channel 12, as well as from being mounted to the substrate 20. Further, if the belt 26 is only attached at the top and bottom of the mounted exercise apparatus 10, the buckles 24 can be positioned anywhere along the length of the apparatus 10. Although the mounted exercise apparatus 10 can be of any length, in one embodiment, buckles 24 can be moved over a span of seven feet which allows the apparatus 10 to accommodate almost anyone regardless of height and for a variety of different exercises.

The belt 26 of the exercise apparatus 10 can have one or more buckles 24 attached to it. For example, FIGS. 1 and 13 show an exercise apparatus 10 having two buckles 24. The buckles 24 are used to attach straps, cords, cables, resistance bands, elastic tubing, or other exercise or training equipment to the exercise apparatus 10. The buckles 24 may be made from a zinc alloy coated in a copper nickel chrome plating, but other materials can be used without departing from the spirit of the invention.

Figure 6:
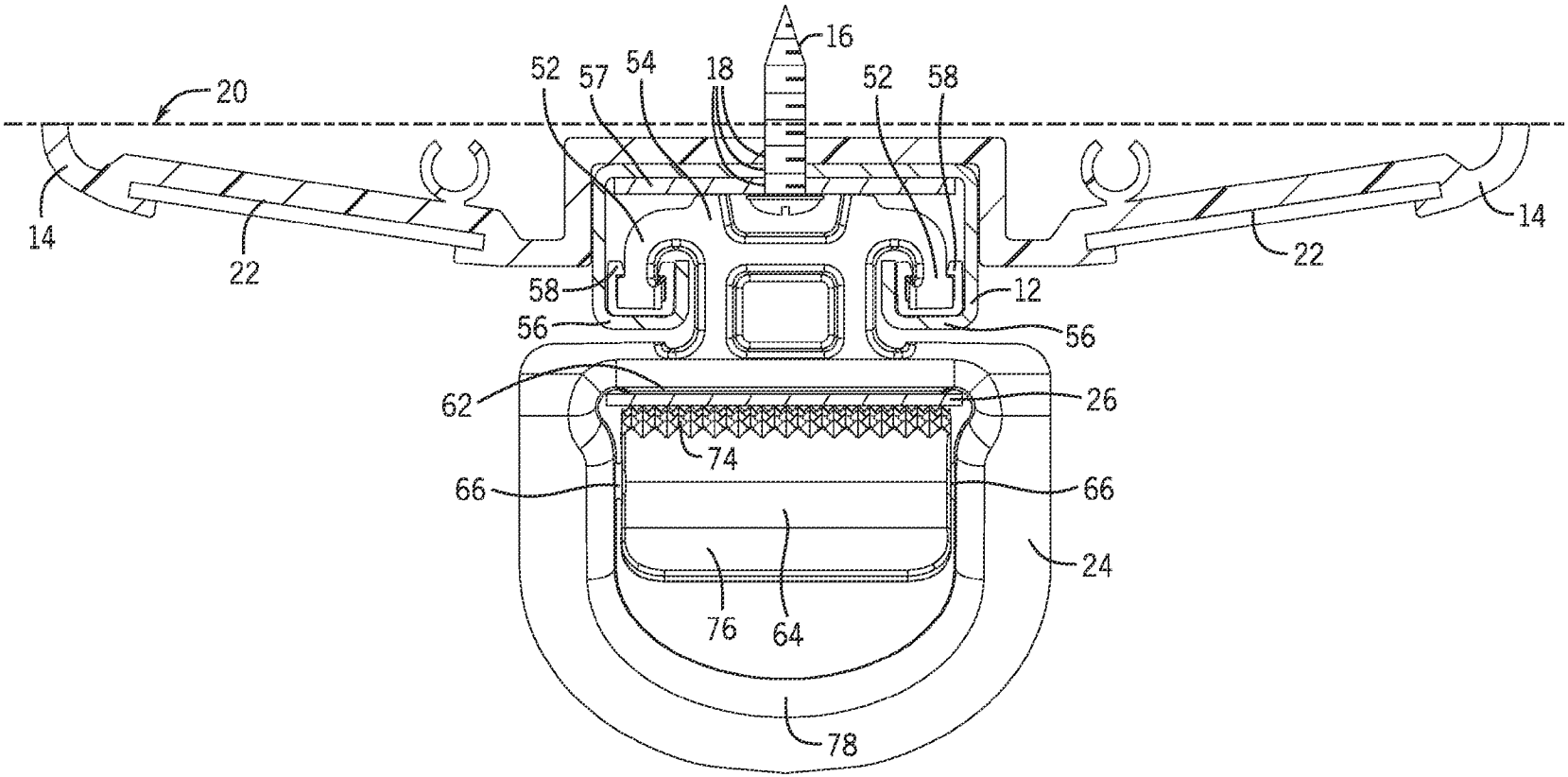
FIG. 6 is a cross-sectional view of the exercise apparatus shown in FIG. 2, taken along the lines 6-6.

Each of the buckles 24 are attached to the exercise apparatus 10 in two ways. First, as shown in FIG. 6, the buckle 24 is attached to the channel 12 by the foot 52 on the bottom portion 54 of the buckle 24. The channel 12 is formed such that it has a rail portion 56 on each of its sides. The foot 52 of the buckle 24 is formed and adapted to fit snugly inside each rail portion 56 of the channel 12. This configuration prevents significant lateral movement, wiggling or torqueing when the mounted exercise apparatus 10 is being used, while still permitting smooth vertical movement of the buckle 24. This configuration also prevents the buckles 24 from being pulled away from the substrate 20 when in use, thus preventing any damage to the substrate 20 or distracting noises.

Figure 7:
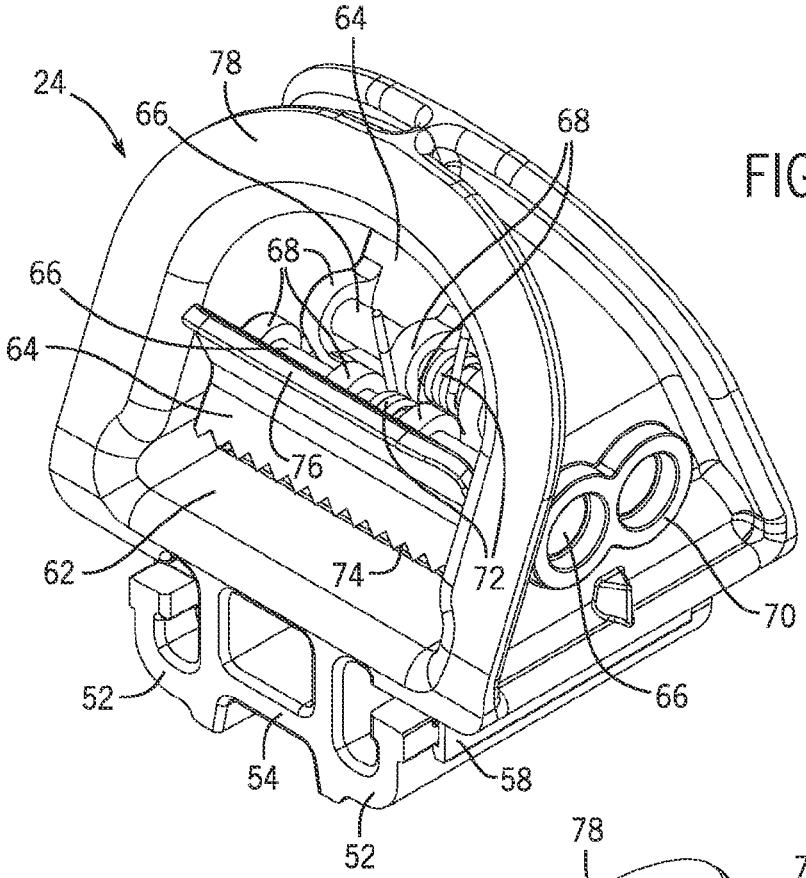
FIG. 7 is an isometric view from the top of a buckle from FIG. 1.
Figure 8:
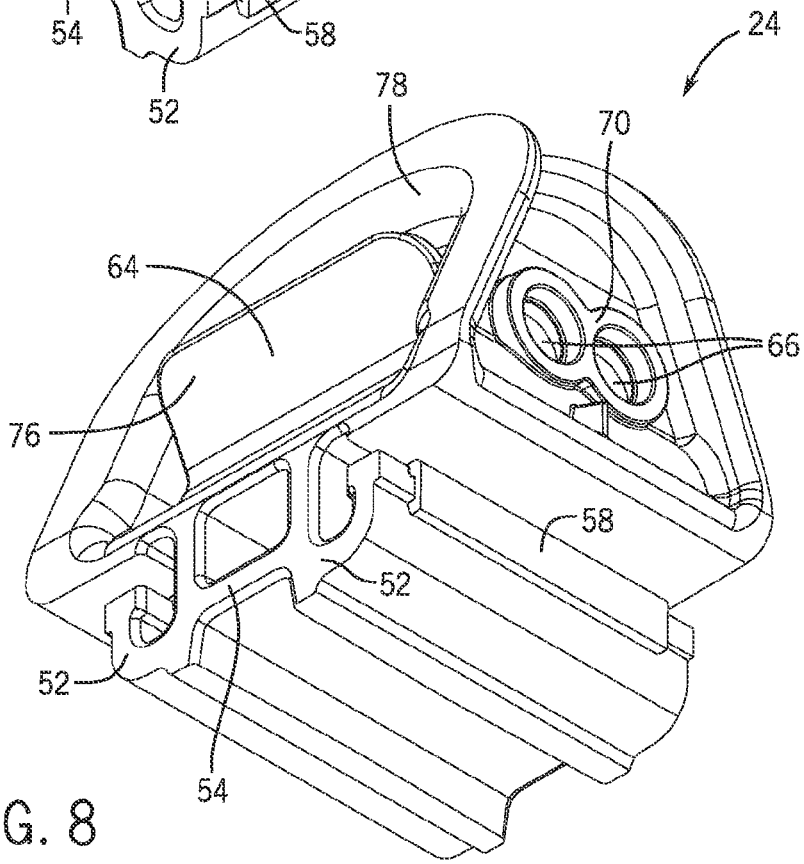
FIG. 8 is an isometric view from the bottom of the buckle from FIG. 7.

As shown in FIGS. 6-8, to further improve smoothness of movement and reduce noise, exercise apparatus 10 may include the use of a slide strip 57 and glides 58. Specifically, the channel 12 may have a slide strip 57 positioned therein, for riding on by the buckle 24. While any of various means of securement may be employed, the slide strip 57 shown in FIG. 6 is secured to the channel 12 and the substrate 20 with screws 16 inserted in holes 18 that match the holes 18 in the base 14 and channel 12. The slide strip 57 is made from extruded plastic or other low friction material and allows the buckle 24 to slide up and down the rail portion 56 more smoothly and quietly. In the embodiment shown in FIGS. 7 and 8, each foot 52 has a glide 58 snapped over it or otherwise connected to it. The glides 58 are made from extruded plastic or other material as described above with respect to slide strip 57, and allow the buckle 24 to slide up and down the rail portion 56 more smoothly and quietly.

Figure 9:
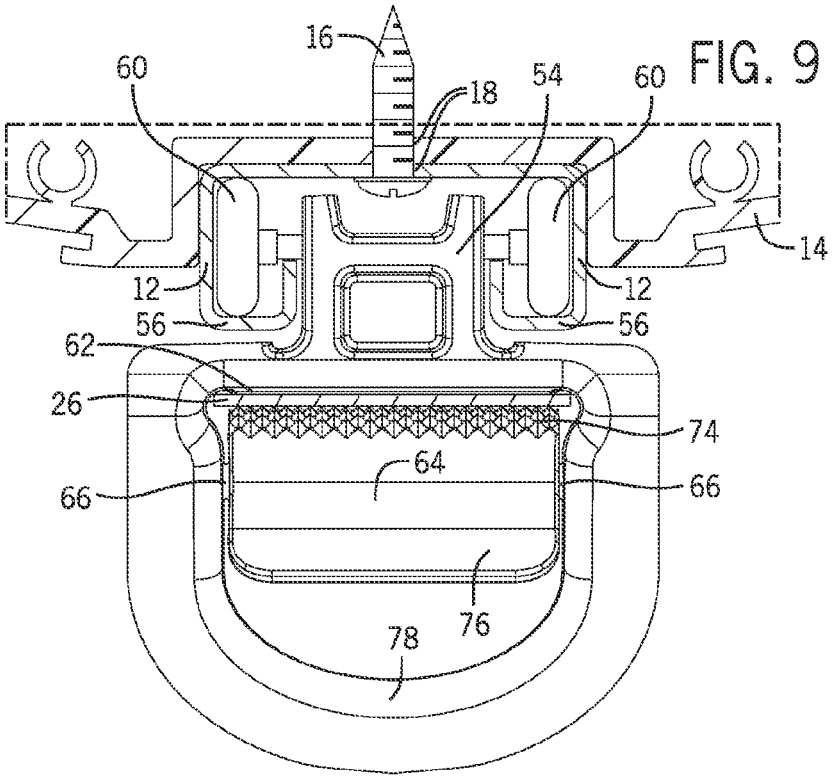
FIG. 9 is a partial cross-sectional view of an alternate embodiment of a buckle for an exercise apparatus in accordance with the invention.
Figure 10:
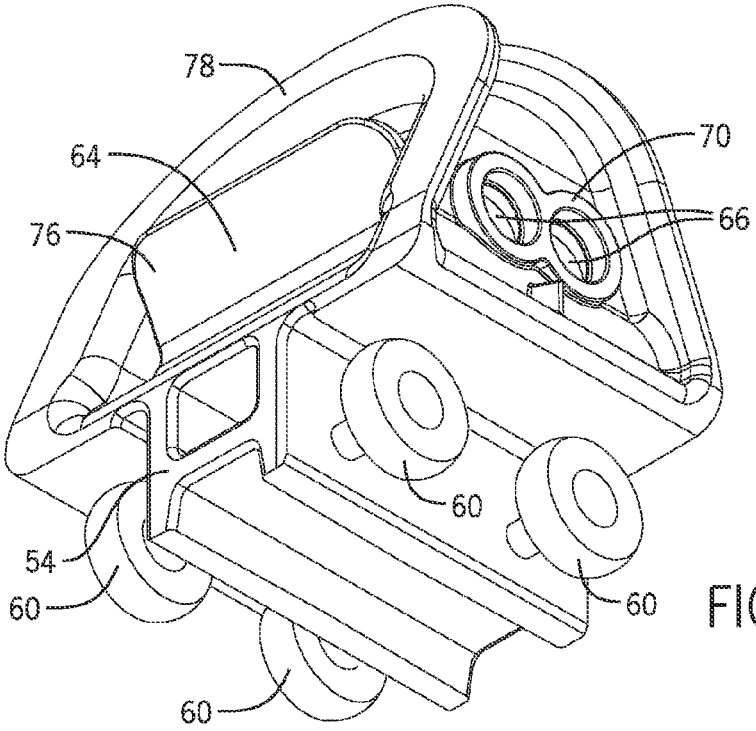
FIG. 10 is an isometric view from the bottom of the buckle from FIG. 9.

In another embodiment, shown in FIGS. 9 and 10, the buckle 24 has a pair of wheels 60 on each side of the bottom portion 54 of the buckle 24 instead of a foot 52, slide strip 57 and/or glides 58. Each pair of wheels 60 rides within a rail portion 56 of the channel 12 and provides smooth and consistent vertical movement of the buckle 24 when the buckles 24 are disengaged from the belt 26, while preventing lateral movement, wiggling or torqueing of the buckle 24. Although more or less than a pair of wheels 60 can be used on each side of the bottom portion 54, a pair of wheels 60 prevents rocking of the buckle 24 within or against the channel 12. Channel 12 or could be shaped in other ways, to interact and cooperate with a foot 52 on buckles 24. For example, a channel 12 could be a rail itself, and the foot 52 could be a slide that travels on the rail. Other configurations are within the scope of the invention as well.

Figure 11:
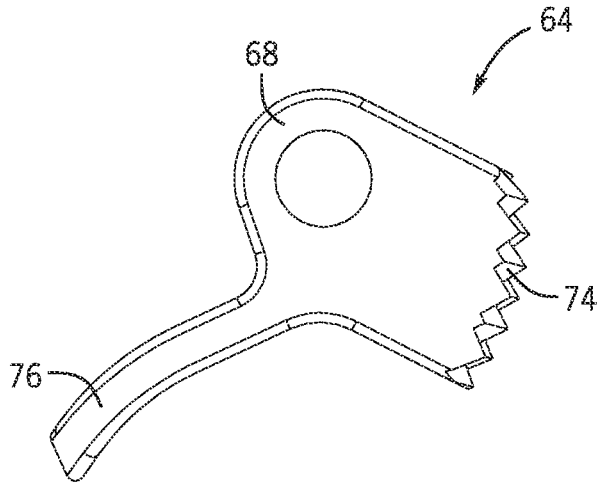
FIG. 11 is a side elevation view of a cam from the buckle of FIG. 7.
Figure 12:
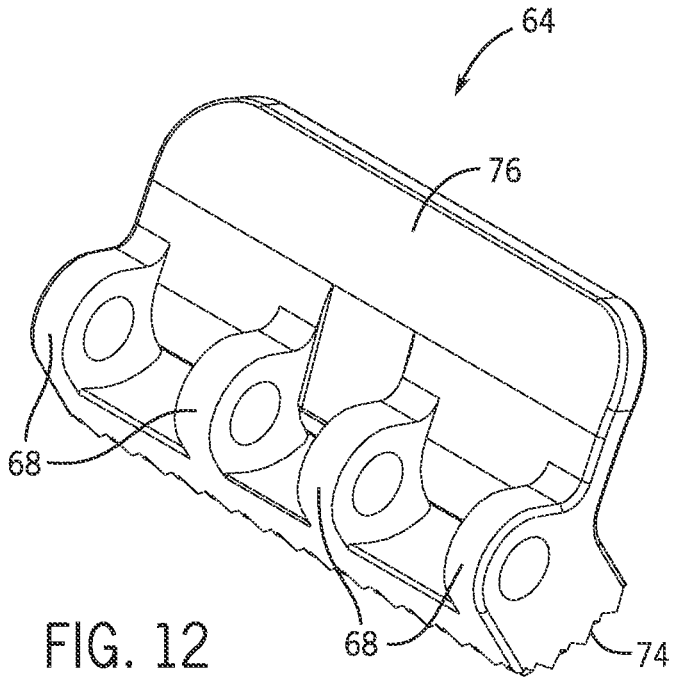
FIG. 12 is an isometric view of the cam from FIG. 11.

The buckles 24 also engage with the belt 26 to selectably permit or resist movement of the buckles along the belt 26. The belt 26 is held between the platform 62 of the buckle 24 and one or both of two opposing cams 64. Each of the two cams 64 of the buckle 24 is rotatably attached to the buckle 24 by means of a retaining shaft 66. A retaining shaft 66 is inserted through the retention brackets 68 of each of the two cams 64, as shown in FIGS. 11 and 12 and held in place by a retention base 70 on each side of the buckle 24. Thus the retaining shaft 66 is held in place by a retention base 70 on one side of the buckle 24, extends through the retention brackets 68 of the cam 64, and held in place by a retention base 70 on the opposite side of the bracket 24 such that the cam 64 can be rotated around the retaining shaft 66.

As shown in FIG. 7, a torsion spring 72 is wrapped around the center of the retaining shaft 66 of each cam 64 to bias the cam 64 toward platform 62. With the belt 26 between the toothed pad 74 of the cam 64 and the platform 62 of the buckle 24, the buckle 24 pinches the belt between the toothed pad 74 and the platform 62, thereby providing resistance against the buckle moving along the belt 26.

As shown in FIGS. 6-12, each cam 64 of the buckle 24 has a lever 76 that can be used to release the belt 26. The lever 76 from each of the two opposing cams 64 is pulled toward the center of the buckle 24, such as by pinching the two levers 76 together using a thumb on one lever 76 and the fingers on another lever 76. When the two levers 76 are rotated towards the center of the buckle 24 the pad 74 of each cam 64 rotates away from the belt 26, thus releasing or disengaging from the belt 26, and allowing the buckle 24 to be moved up and down the belt 26, as well as the channel 12, as previously described. When the lever 76 of each cam 64 is released, the spring 72 biases the toothed pad 74 of the cam 64 back towards the belt 26 thereby pinching the belt 26 and securing or engaging the buckle 24. This configuration is sometimes referred to as a double cam spring action lever and allows the buckles 24 to be quickly and smoothly moved from one position to another.

Figure 14:
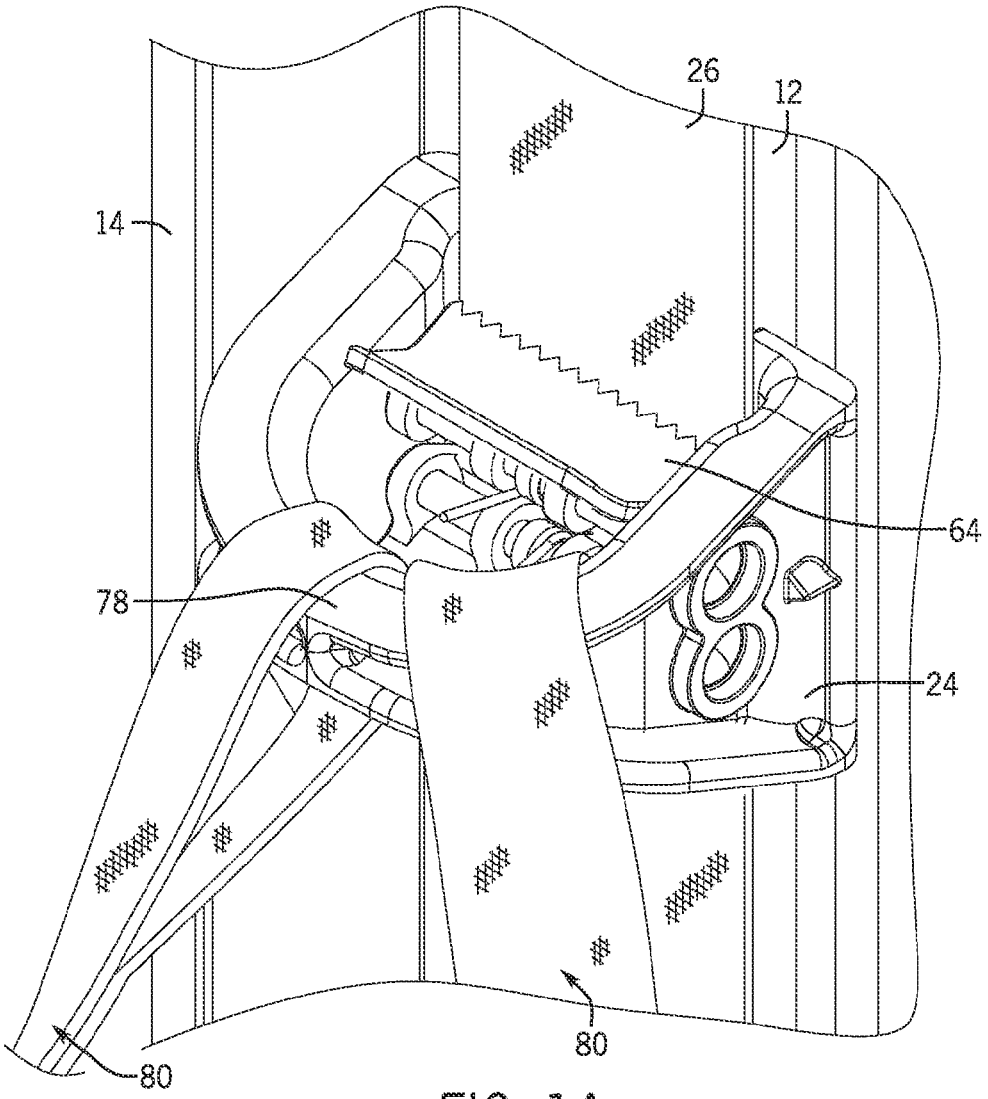
FIG. 14 is a perspective view of a buckle for an exercise apparatus in accordance with the present invention showing straps attached to the attachment portion of the buckle.

The buckle 24 also has an attachment portion 78, to which exercise devices or other attachments may be attached. As shown in FIG. 13, two buckles 24 are attached to the exercise apparatus 10, one for arm exercises and one for leg exercises, although more or fewer buckles 24 may be included as needed. As shown in FIG. 14, the attachment portion 78 is shown as a support structure having an aperture, but other structures could also be used for attachment portion 78, such as slots, clips, flat structures, or other shaped support and/or aperture style structures. Elastic bands, cable or cords or can be attached to the attachment portion 78 of the buckle 24 by any known method such as straps 80. As seen in FIG. 13, exercise devices 82 can also be used in connection with the exercise apparatus 10 by connecting such exercise devices 82 to the buckles 24. Examples of exercise devices 82 that can be connected to the exercise apparatus 10 include a wide variety of straps, cords, resistance cables, bands, tubing, or other devices that could be pushed, pulled, or moved with respect to the exercise apparatus.

Figure 16:
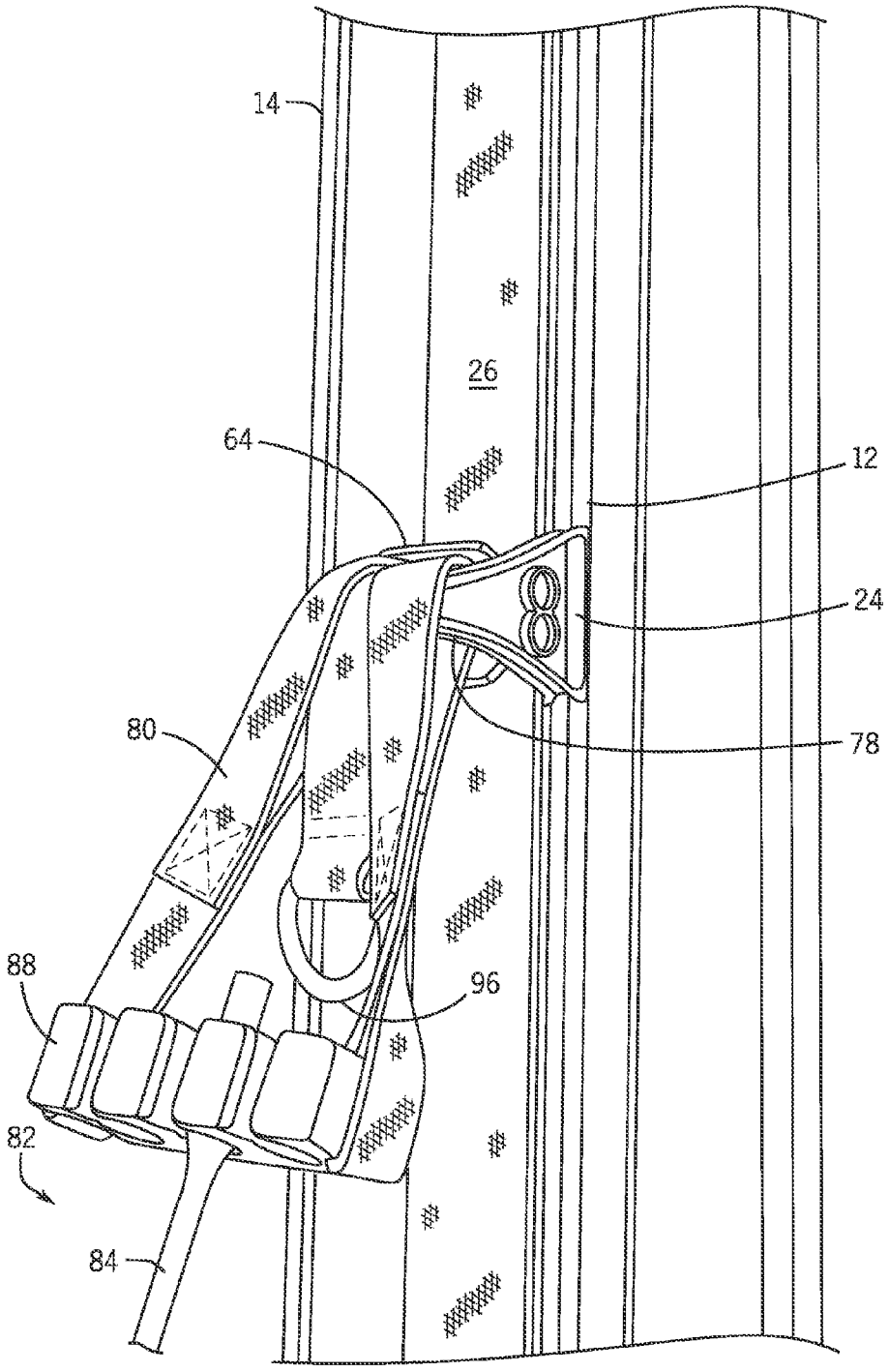
FIG. 16 is a perspective view of a buckle for an exercise apparatus in accordance with the present invention, showing straps attached to the attachment portion of the buckle along with an attachment anchor, a force sensing device, a resistance cable and a connection ring.
Figure 17:
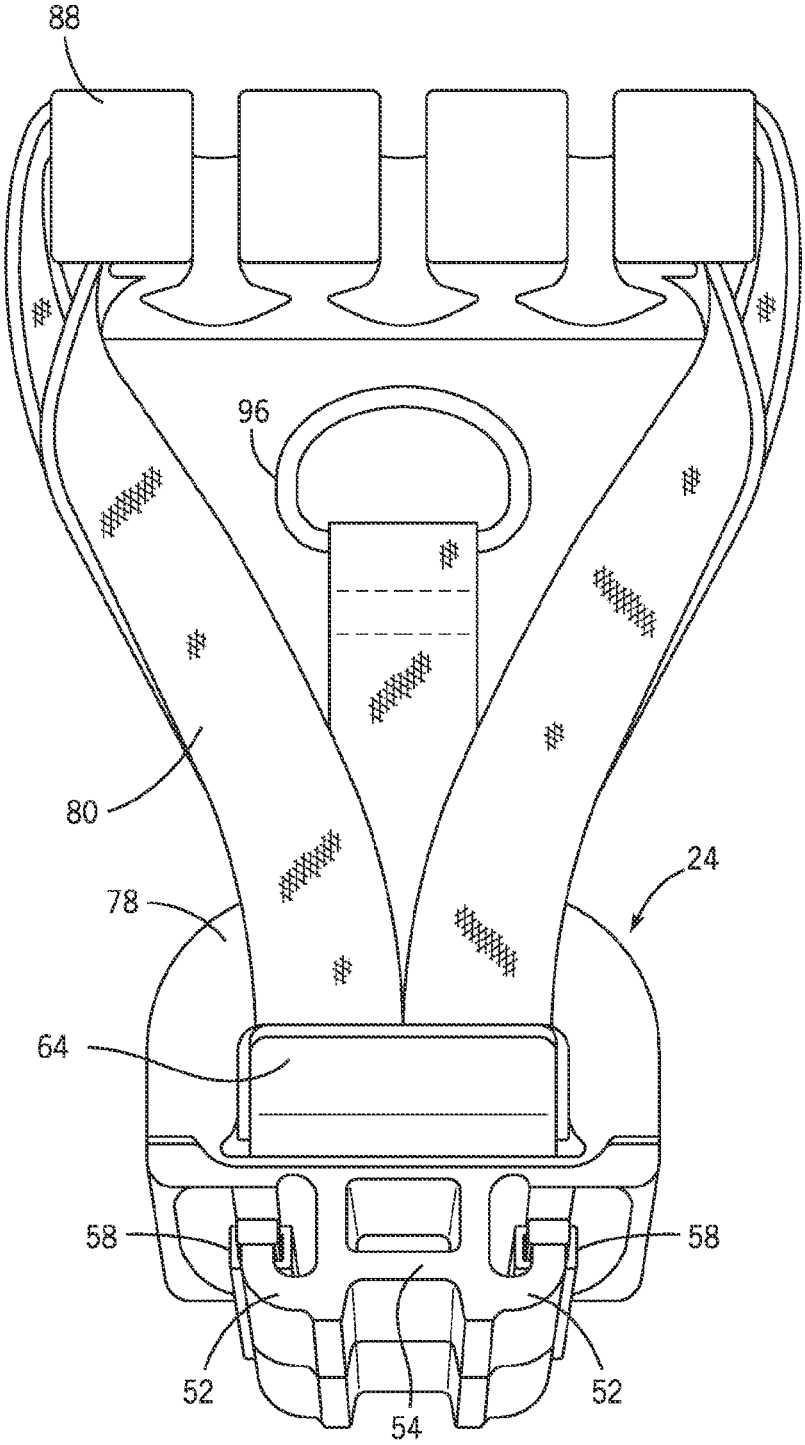
FIG. 17 is a perspective view of the buckle with an attachment anchor and a connection ring from FIG. 16.

Examples of attachment mechanisms include a wide variety of hooks, straps, carabineers, links, or other fasteners, including the attachment mechanisms disclosed in U.S. Pat. Nos. 6,923,750 and 6,497,641 which are hereby incorporated by reference herein in their entirety for all purposes, examples of which are shown in FIGS. 15-17. The exercise device 82 shown in FIG. 13. includes a resistance cable 84 and a handle 86 attached to one end of the resistance cable 84. The exercise device 82 shown in FIG. 15. additionally includes a cable anchor 88 capable of attaching multiple cables to the buckle 24, such as for example, by another end of the resistance cable 84, and a force sensing apparatus 90 that can be used to, for example, track individually customized exercise routines, monitor compliance and performance, and report results. The buckle 24 shown in FIGS. 16-17 includes a cable anchor 88 and connection ring 96 which are attached to the buckle 24 by straps 80. The connection ring 96 can be used to quickly attached and detach the exercise devices 82 with, for example, hooks, carabineers or links.

Although the invention has been herein described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein.

What is claimed is:

1. A mountable exercise apparatus comprising:

a base;

a channel having a first end and a second end, the channel cooperating with the base such that the channel and the base can be mounted to a surface;

a belt having a first end and a second end, the first end of the belt connected to the first end of the channel, and the second end of the belt connected to the second end of the channel; and at least one buckle with a top portion and a bottom portion, the bottom portion adapted to fit within the channel such that the at least one buckle is movable along the channel and resists moving in either perpendicular direction thereto, and the top portion comprising:

an attachment portion for attaching exercise equipment; and at least one cam that is selectively engaged with the belt such that when the at least one cam is disengaged the at least one buckle can be moved along the belt and when engaged the at least one buckle resists moving with respect to the belt.

2. The mountable exercise apparatus of claim 1 wherein the channel includes a rail portion and the bottom portion of the at least one buckle has a foot which is sized to fit within the rail portion such that the at least one buckle is movable along the channel and resists moving in either perpendicular direction thereto.

3. The mountable exercise apparatus of claim 2 further comprising a glide that is connected to the foot.

4. The mountable exercise apparatus of claim 2 further comprising a slide that is disposed within the rail portion of the channel.

5. The mountable exercise apparatus of claim 1 wherein the at least one buckle further comprises a spring action lever.

6. The mountable exercise apparatus of claim 1 wherein the base has a passage that is sized such that the channel at least partially fits within the passage.

7. The mountable exercise apparatus of claim 1 wherein the bottom portion of the at least one buckle further comprises two or more wheels operably mounted thereto, each of the two or more wheels are sized to fit within the channel such that the at least one buckle is movable along the channel and resists moving in either perpendicular direction thereto.

8. The mountable exercise apparatus of claim 1 wherein the base is capable of holding and displaying information.

9. The mountable exercise apparatus of claim 1 wherein the channel is integrally formed with the base.

10. The mountable exercise apparatus of claim 1 wherein when the apparatus is installed, the mounting of the base and channel and the connecting of the belt to the channel are each substantially covered by a cap.

11. A mountable exercise apparatus comprising:

a base;

a channel with a top and a bottom, wherein the channel is connected to the base;

a belt with a top and a bottom, the top of the belt connected to the top of the channel and the bottom of the belt connected to the bottom of the channel; and at least one buckle, wherein the at least one buckle includes a selectably engaging mechanism that connects the belt to the channel such that the at least one buckle can be moved along the belt and channel when the selectably engaging mechanism is disengaged and the at least one buckle resists movement when the selectably engaging mechanism is engaged, wherein the selectably engaging mechanism is in constant engagement with the channel and can engage and disengage from the belt, and wherein the selectably engaging mechanism engages the belt by pinching the web belt and disengages the belt by releasing the belt.

12. A mountable exercise apparatus comprising:

a base;

a channel with a top and a bottom, wherein the channel is connected to the base;

a belt with a top and a bottom, the top of the belt connected to the top of the channel and the bottom of the belt connected to the bottom of the channel; and at least one buckle, wherein the at least one buckle includes a selectably engaging mechanism that connects the belt to the channel such that the at least one buckle can be moved along the belt and channel when the selectably engaging mechanism is disengaged and the at least one buckle resists movement when the selectably engaging mechanism is engaged, wherein the at least one buckle can be positioned in an infinite number of positions between the top and bottom of the belt.

13. The mountable exercise apparatus of claim 12 where the at least one buckle further comprises:

a first cam and a second cam, both the first cam and the second cam capable of independently selectively engaging the belt, such that when both the first cam and the second cam are disengaged, the at least one buckle can be moved along the belt; and an attachment position for attaching an exercise device.

14. A mountable exercise apparatus comprising:

a base;

a channel with a top and a bottom, wherein the channel is connected to the base;

a belt with a top and a bottom, the top of the belt connected to the top of the channel and the bottom of the belt connected to the bottom of the channel; and at least one buckle, wherein the at least one buckle includes a selectably engaging mechanism that connects the belt to the channel such that the at least one buckle can be moved along the belt and channel when the selectably engaging mechanism is disengaged and the at least one buckle resists movement when the selectably engaging mechanism is engaged; and a winch connecting the belt in place with respect to the channel.

15. A mountable exercise apparatus comprising:

a back plate having formed therein a set of back plate holes, and comprising:

at least one surface for holding and displaying information;

a channel comprising:

a top; and a bottom; the channel having formed therein a set of channel holes, at least some of which channel holes match the number and location of at least some of the back plate holes, wherein screws can be used to mount the back plate and the channel to a wall;

a belt with a first end and a second end, wherein the first end is engaged with the top of the channel;

a winch connected to the second end of the belt and sized to fit within the bottom of the channel such that when the winch is operated, the belt is tightened and the winch is secured in position with respect to the channel;

at least one buckle comprising:

an attachment portion;

at least one foot, wherein the at least one foot is sized to fit within and continuously engage the channel; and at least two cams, wherein each of the at least two cams is operable such that when either of the at least two cams is closed the at least one buckle engages the belt and resists movement of the at least one buckle along the belt, and when each of the at least two cams is opened the at least one buckle is movable along the belt; and a first and second cap, wherein the first cap is sized to fit over the top of the channel and belt and the second cap is sized to fit over the winch and the bottom of the channel.

16. The mountable exercise apparatus of claim 15 further comprising an exercise device attached to the attachment portion such that it may be used for exercising.

17. The mountable exercise apparatus of claim 16 wherein the attachment between the exercise device and the attachment portion includes a force sensing device.

18. The mountable exercise apparatus of claim 17 wherein a first end of the exercise device includes a cable anchor capable of attaching multiple cables to the mountable exercise apparatus and a second end of the exercise device includes a handle.

* * * * *

UNITED STATES PATENT AND TRADEMARK OFFICE

CERTIFICATE OF CORRECTION

PATENT NO. : 9,339,682 B2
APPLICATION NO. : 14/075747
DATED : May 17, 2016
INVENTOR(S) : Braier et al.

It is certified that error appears in the above-identified patent and that said Letters Patent is hereby corrected as shown below:

In the claims
Column 8
Line 42, the word "web" should be deleted.

Signed and Sealed this
Twelfth Day of July, 2016

Michelle K. Lee

Michelle K. Lee
*Director of the United States Patent and Trademark Office*